United States Patent [19]

Delphia

[11] 4,095,592

[45] Jun. 20, 1978

[54] DOUBLE BREATH DIVERS VALVE

[76] Inventor: John B. Delphia, 1021 Schuyler St., Milford, Mich. 48042

[21] Appl. No.: 754,166

[22] Filed: Dec. 27, 1976

[51] Int. Cl.[2] ..... A62B 7/00

[52] U.S. Cl. ..... 128/142 R; 128/142.2

[58] Field of Search ..... 128/142 R, 142.2, 142.3, 128/142.7, 145.6, 145.8, 147, 202, 203, DIG. 17

[56] References Cited

U.S. PATENT DOCUMENTS

| | | | |
|---|---|---|---|
| 3,200,816 | 8/1965 | Bartlett, Jr. | 128/142.2 |
| 3,827,432 | 8/1974 | Lundgren et al. | 128/142.2 |
| 3,923,053 | 12/1975 | Jansson | 128/142 R |
| 4,031,887 | 6/1977 | Botos et al. | 128/142 R |

*Primary Examiner*—Robert W. Michell
*Assistant Examiner*—Henry J. Recla
*Attorney, Agent, or Firm*—McGlynn and Milton

[57] ABSTRACT

A respiratory mask including a mouthpiece in a breathing conduit or passage for conveying breathing gas to and from a breathing chamber. The breathing chamber has collapsible or diaphragm-like walls for expanding and contracting in response to the pressure of the ambient medium surrounding the mask, such as water, as the mask is utilized by a diver. A fresh air gas supply conduit is connected to the respiratory mask for supplying breathing gas to the breathing chamber upon the breathing demand of the wearer of the mask. The breathing gas in the breathing chamber is utilized twice as an exhaust valve connecting the breathing chamber with the ambient medium is maintained closed during two consecutive breathing cycles by an electromagnet which is energized through a replaceable battery in the mask and controlled through an electronic circuit responsive to a bellows which reacts to each breathing cycle of the wearer. In addition, should the electromagnet fail the exhaust valve is biased to the closed position by a spring and operates as a normal exhaust valve during each breathing cycle.

10 Claims, 1 Drawing Figure

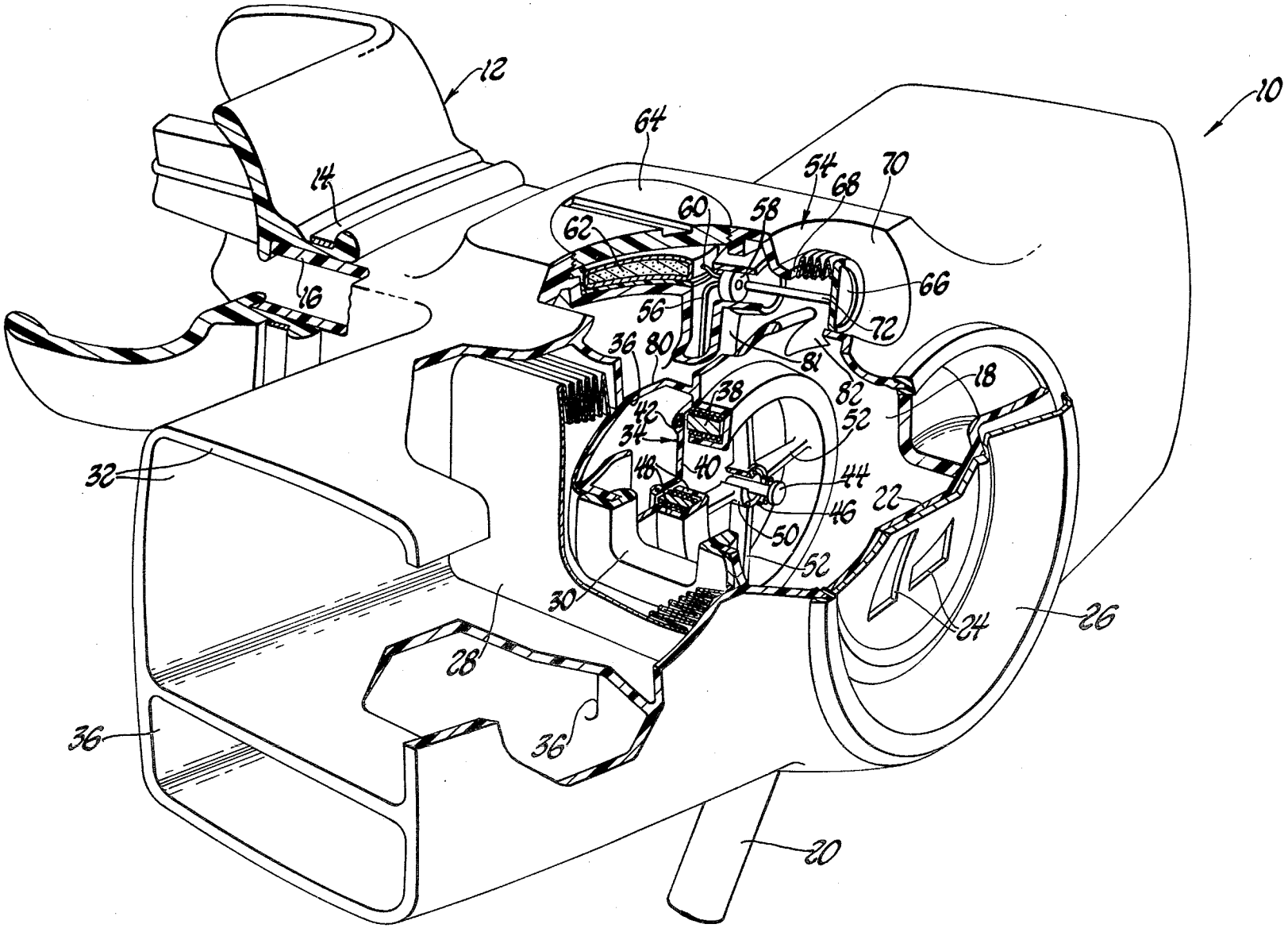
10
12
14
16
18
20
22
24
26
28
30
32
34
36
38
40
42
44
46
48
50
52
54
56
58
60
62
64
66
68
70
72
80
81

DOUBLE BREATH DIVERS VALVE

This invention relates to a breathing assembly of the type used for underwater diving and/or aviation and the like.

Such breathing apparatus, and particularly breathing apparatus utilized by an underwater diver, have been classified as the open-circuit-type and the closed-circuit-type. There have been various attempts with both systems to increase their efficiency so that the diver maximizes the use of the oxygen in the system. It is well known that air consists of approximately 20 percent oxygen and 80 percent nitrogen and that a human being, during breathing, utilizes only approximately 20 to 25 percent of the oxygen breathed.

In a closed system where the breathed gas is recirculated and never exhausted to the ambient medium or water, the breathed gas is typically passed through a device for removing the carbon dioxide with the purified gas being supplemented with additional oxygen. There are many disadvantages to the close-circuit-type including limitations upon the diving depth and the equipment required.

The subject invention is specifically directed to the open-circuit-type of breathing assembly. Typically, such an assembly is supplied breathing gas, such as a mixture of oxygen and an inert gas, such as nitrogen, from high-pressure storage containers through a regulator valve which reduces the pressure of the gases to a demand-type valve which is, in turn, controlled by the respiratory cycles of the diver. Normally, a diaphragm reacts to the pressure of the ambient medium, such as the water, and to the breathing pressure of the diver to control the demand valve for supplying additional breathing gas. In addition, there is normally included an exhaust valve which exhausts the exhaled gas to the ambient medium. There is, therefore, typically no rebreathing of the exhaled breathing gas in an open-circuit-type breathing assembly. Thus, the biggest disadvantage of an open-circuit-type breathing assembly is the very inefficient manner in which the oxygen is utilized, although it has the very distinct advantage of being automatic in that the breathing gas supplied to the diver is automatically compensated for pressure difference as the diver rises or descends in the water.

Some of the patented prior art assemblies are disclosed in the U.S. Pat. No. 3,021,839 granted to D. L. Marsh on Feb. 20, 1962; U.S. Pat. No. 3,682,165 granted to Erik Eklund on Aug. 8, 1972 and U.S. Pat. No. 3,827,432 granted to C. E. G. Lundgren et al on Aug. 6, 1974.

In accordance with the subject invention there is provided a breathing assembly for rendering an open-circuit-type breathing assembly more efficient by reusing the breathed gas at least once but which, upon certain malfunctions, would operate as a normal open-circuit-type breathing assembly where breathed gas would be discharged to the ambient medium during each breathing cycle.

In accordance with the subject invention there is provided a breathing assembly including a breathing chamber, means for storing breathing gas, fresh gas supply means for feeding fresh breathing gas into the breathing chamber means to replace breathing gas that has been consumed and exhausted to the ambient medium, breathing passage means for conveying breathing gas from the breathing chamber means and returning consumed gas to the breathing chamber means, and exhaust valve means in communication with the breathing chamber means for opening to exhaust breathing gas from the breathing chamber means to the ambient medium during each breathing cycle and including control means for allowing the exhaust valve means to open only in response to the occurrence of a plurality of breathing cycles whereby the exhaust valve means opens during each breathing cycle upon the inoperation of the control means.

Other advantages of the present invention will be readily appreciated as the same becomes better understood by reference to the following detailed description when considered in connection with the accompanying drawings wherein the only FIGURE is a perspective view partially broken away and in cross section showing a preferred embodiment of the subject invention.

A breathing assembly of the type used for underwater diving or the like and constructed in accordance with the subject invention is generally shown at 10.

The breathing assembly 10 takes the form of a diving mask having a mouthpiece section 12 connected by a retaining band or ring 14 to a flange 16 which defines a breathing passage means. The mouthpiece 12, as well as the body portion defining the walls 16 are preferably made of a plastic or organic polymeric material.

The body includes walls defining a breathing chamber means 18 for storing breathing gas.

A fresh gas supply means including the conduit 20 feeds fresh breathing gas into the breathing chamber means 18 to replace breathing gas that has been consumed and exhausted to the ambient medium. The conduit 20 is adapted for connection to a source of pressurized breathing gas through a pressure regulator. In other words, the conduit 12 would be connected to tanks of breathing gas with a regulator for controlling the flow of the breathing gas out of the tanks and also including a demand valve associated with the conduit 20 which is operated by the diaphragm portion 22. The diaphragm portion 22 of the housing is subjected to the pressure of the ambient medium or water through the cutouts 24 in the metal cup or decorative member 26. The inside of the diaphragm 22 is subjected to the breathing pressure within the breathing chamber 18. The position of the diaphragm 22 controls the demand-type valve in the conventional manner.

In addition, the breathing chamber 18 is expandable and contractable for varying the volume in response to the ambient medium. More specifically, a portion of the breathing chamber 18 is defined by the expandable bellows or diaphragm-type members having an inner lip retained about an opening by the retaining member 30. The outward faces of the members 28 are disposed within the openings 32 which are open to the ambient medium or water, the pressure of which acts upon the faces of the members 28.

The mouthpiece 12 defines the end of the breathing passage means 16 which, in turn, conveys breathing gas from the breathing chamber 18 and returns the consumed gas from the consumer to the breathing chamber 18.

The assembly also includes exhaust valve means generally shown at 34 which is in communication with the breathing chamber means 18 for opening to exhaust breathing gas from the breathing chamber means 18 to the ambient medium or water during each breathing cycle. Specifically, the body includes an exhaust passage 36 which extends through the body to a position rearwardly of and adjacent the valve means 34.

The exhaust valve means 34 includes a valve seat defined by the electromagnet means 38 and a valve member 40 cooperable with the valve seat. The valve member 40 is a circular disc having an outer periphery with a metal insert 42 embedded therein to magnetically cooperate with the electromagnet means 38. A spindle 44 extends from the central portion of the valve disc 40 and a biasing means comprising a spring 46 is disposed thereabout to engage the head of the spindle 44 for urging the valve disc 40 into sealing engagement with the valve seat defined by the electromagnet means 38 and its enclosure. The electromagnetic means 38 is disposed within an enclosure defined by the annular walls 48 with which the valve disc 40 also seats. The spindle 44 extends through a hub 50 which is centrally supported by the spokes 52. The valve member 40 moves against the biasing action of the spring 46 to compress the spring 46 in response to there being a predetermined positive pressure within the breathing chamber 18, as when breathing gas is being exhaled thereinto.

There is also included control means generally shown at 54 for allowing the valve member 40 to open only in response to the occurrence of a plurality of breathing cycle whereby the valve 40 opens during each breathing cycle upon the inoperation of the control means 54. Said another way, upon the inoperation or the failure to energize the electromagnetic means 38, the valve 40 will operate like a normal exhaust valve whereby it will be closed except for the exhalation of breathed air for exhausting same during each breathing cycle or each time the wearer breathes. However, the control means 54 energizes the electromagnet means 38 to create a magnetic field coacting with the metal insert 42 for maintaining the valve member 40 closed during a plurality or, specifically, two consecutive breathing cycles. The electromagnetic means 38 is energized through an electrical lead 56 which is connected to an electrical circuit means 58 which is, in turn, connected through a lead 60 to a replaceable electric battery 62.

A removable cap 64 threadedly engages the housing and forms a moisture-proof seal therewith for allowing the insertion and removal of the battery 62 as for replacing the battery 62 when it has lost its electrical energy.

The control means 54 includes the diaphragm means 66 which includes a bellows connected to the body in a sealed fashion at 68 and disposed within a recess 70 in the body for exposure to the ambient medium or water. Attached to the diaphragm is an actuating rod 72 which coacts with the switching means 58. The switching means 58 includes a conventional flip flop and circuit for responding to the breathing cycles to energize the electromagnetic means 38 by supplying electrical current therethrough from the battery 62 and for de-energizing the electromagnetic means 38 for allowing the valve member 40 to open upon every other breathing cycle.

The breathing gas passes to and from the breathing chamber 18 to the mouthpiece 12 through the passage 16 which extends above the wall 80 about the pedestal 81 through the cutout passage 82.

During the operation of the assembly there will be a mode whereby electrical energy is not being supplied to the electrical magnetic means 38 whereby, upon exhalation of breathing gas from the mouthpiece 12 and through the passage 16 and into the breathing chamber 18, the exhaled gas pressure will act upon the valve member 40 to open the exhaust valve member 40 allowing the exhaust of breathed gas out through the passage 36. Upon the next inhalation of gas the valve member 40 will close. At the same time a reduction in pressure will act upon the diaphragm 66 on the interior thereof and the exterior ambient medium or water pressure forces the diaphragm 66 inwardly to move the rod 72 into engagement with the switching means 58. At the same time of this inhalation of breathing gas, the demand valve replenishes breathing gas into the chamber 18 through the fresh gas passage or inlet means 20. When the switching means 58 is contacted electrical energy is supplied from the battery 62 to the electromagnetic means 38 creating an electromagnetic field acting upon the metal insert 42 to hold the valve disc member 40 in the closed position. Upon the exhalation of breathing gas into the breathing chamber 18, the expandable members 28 expand to accommodate the volume while the disc member 40 is held in the closed position by the action of the magnetic field plus the action of the spring 46. During the next inhalation, breathing gas is inhaled from the breathing gas chamber 18 and again the rod 72 contacts the switching means 58 at which time means cuts off the supply of electrical energy to the electromagnetic means 38. In this condition, only the spring 46 retains the valve 40 in the closed position. Thereafter, and upon exhalation into the breathing chamber 18, the valve 40 opens under the pressure of the exhaled breathing gas to exhaust through the passage 36. Upon the next inhalation gas is replenished in the breathing chamber 18 and the rod 72 contacts the switch 58 to again energize the electromagnetic means 38 so that the exhaust valve means will not open during exhalation so that the exhaled gas is reused.

The switching means may utilize a conventional flip flop which, upon a first input, produces a high output and upon the successive input produces a low output and continues to alternate in such a fashion. Thus, such a flip flop may be utilized to alternately provide an on and off signal for supplying electrical energy from the battery 62 to the electromagnetic means 38.

As will be appreciated, should the battery 62 or any of the control means 54 fail to energize the electromagnetic means 38, the exhaust valve member 40 will react in a normal fashion and will open upon each exhalation.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

The embodiments of the invention in which an exclusive property or privilege is claimed are defined as follows:

1. A breathing assembly of the type used for underwater diving and comprising; breathing chamber means for storing breathing gas, fresh gas supply means for feeding fresh breathing gas into said breathing chamber means to replace breathing gas that has been consumed and exhausted to the ambient medium, breathing passage means for conveying breathing gas from said breathing chamber means to a consumer and returning consumed gas to said breathing chamber means, and a normally-opened exhaust valve means in communication with said breathing chamber means for exhausting breathing gas from said breathing chamber means to the ambient medium in response to each breathing cycle, and including control means operable upon said exhaust valve means for allowing said exhaust valve means to open only in response to the occurrence of a plurality of breathing cycles while allowing said valve means to open during each breathing cycle only upon the inoperation of said control means.

2. An assembly as set forth in claim 1 wherein said exhaust valve means includes a valve seat and a valve member operable with said seat and biasing means urging said valve member against said valve seat.

3. An assembly as set forth in claim 2 wherein said valve member moves against the biasing action of said biasing means in response to a predetermined positive pressure within said breathing chamber.

4. An assembly as set forth in claim 3 wherein said control means includes an electromagnetic means cooperable with said valve member for maintaining said valve member closed during said plurality of breathing cycles.

5. An assembly as set forth in claim 4 wherein said control means includes electrical switching means responsive to said breathing cycles for energizing said electromagnetic means.

6. An assembly as set forth in claim 5 wherein said control means includes diaphragm means responsive to the breathing gas and ambient medium for actuating said switching means.

7. An assembly as set forth in claim 6 wherein said control means includes a replaceable battery connected to said switching means for energizing said electromagnetic means.

8. An assembly as set forth in claim 7 wherein said switching means includes a circuit means for producing a signal for de-energizing said electromagnetic means for allowing said valve member to open upon every other breathing cycle.

9. An assembly as set forth in claim 8 wherein at least a portion of said breathing chamber means is expandable and contractable for varying the volume thereof in response to the ambient medium.

10. An assembly as set forth in claim 9 wherein said breathing passage means includes a mouthpiece and said fresh air supply means is adapted for connection to a source of pressurized breathing gas through a pressure regulator.

* * * * *